US007949282B2

(12) United States Patent
Mase

(10) Patent No.: US 7,949,282 B2
(45) Date of Patent: May 24, 2011

(54) DEVELOPING DEVICE AND IMAGE FORMING APPARATUS INCLUDING THE SAME

(75) Inventor: Soichiro Mase, Handa (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 548 days.

(21) Appl. No.: 12/028,867

(22) Filed: Feb. 11, 2008

(65) Prior Publication Data

US 2008/0205926 A1 Aug. 28, 2008

(30) Foreign Application Priority Data

Feb. 27, 2007 (JP) ..... 2007-047475

(51) Int. Cl.
*G03G 15/08* (2006.01)

(52) U.S. Cl. ..... 399/103; 399/29; 399/119

(58) Field of Classification Search ..... 399/113, 399/120

See application file for complete search history.

(56) References Cited

U.S. PATENT DOCUMENTS 5,384,629 A * 1/1995 Watanabe et al. ..... 399/120
5,506,665 A 4/1996 Ishida et al.
5,568,237 A 10/1996 Ishida et al.
5,608,501 A 3/1997 Makino

FOREIGN PATENT DOCUMENTS

JP 07-225514 8/1995
JP 07-306589 11/1995

* cited by examiner

*Primary Examiner* — David M Gray
*Assistant Examiner* — Roy Yi
(74) *Attorney, Agent, or Firm* — Banner & Witcoff, Ltd.

(57) ABSTRACT

A developing device includes a housing, a developing roller that carries developer, a supply roller for supplying the developer, a developer cartridge that accommodates the developer, a first sealing member that is provided at both ends of the developing roller, a developer passage opening provided in at least one of the housing and the developer cartridge, and a second sealing member provided in a vicinity of the developer passage opening. At least a part of the second sealing member overlaps the first sealing member in a direction in which the developer cartridge is attachable to and detachable from the housing. A portion of a shadow of the second sealing member cast in a direction, in which the developer passes through the developer passage opening, overlaps the first sealing member. The developer cartridge is attachable to and detachable from the housing at a position opposed to the developing roller.

11 Claims, 11 Drawing Sheets

DEVELOPING DEVICE AND IMAGE FORMING APPARATUS INCLUDING THE SAME

CROSS-REFERENCE TO RELATED APPLICATIONS

This application claims priority from Japanese Patent Application No. 2007-047475 filed on Feb. 27, 2007, the entire subject matter of which is incorporated herein by reference.

TECHNICAL FIELD

Aspects of the present invention relate to an image forming apparatus, and a developing device attached to the image forming apparatus.

BACKGROUND

There has been proposed a laser printer having a developing device wherein a toner box for housing a toner is attachable to and detachable from the developing device (see, for example, JP-A-7-225514).

JP-A-7-225514 discloses a developing device including a toner box and a case. The toner box includes a toner outlet for discharging toner, and a first shutter for closing the toner outlet. The case of the developing device includes a toner inlet for receiving the toner discharged from the toner outlet, and a second shutter for closing the toner inlet. In the toner box, a sealing material is interposed between the toner box and the first shutter, and around the toner outlet. In the case, a sealing material is interposed between the case and the second shutter, and around the toner inlet.

SUMMARY

Aspects of the present invention provide a developing device capable of preventing leakage of developer by reducing a degree of deformation in edges of developer passage openings in a housing by a simple configuration. Further, aspects of the present invention provide an image forming apparatus including the developing device.

DETAILED DESCRIPTION

General Overview

Figure 1:
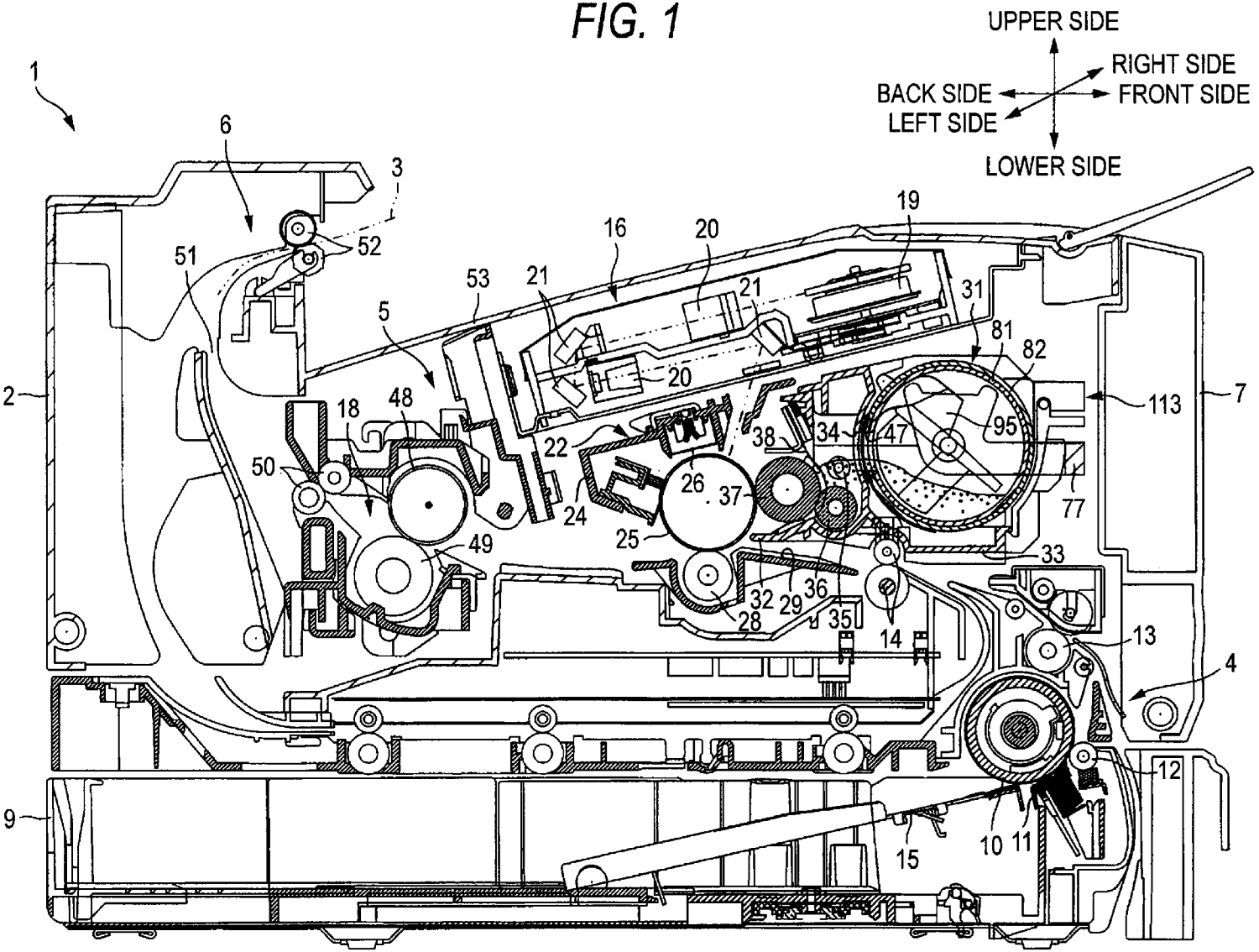
FIG. 1 is an exemplary side sectional view showing an image forming apparatus according to an aspect of the present invention.

According to an aspect of the present invention, there is provided a developing device including: a housing; a developing roller that is rotatably provided in the housing and carries developer; a supply roller for supplying the developer to the developing roller; a developer cartridge that is attachable to and detachable from the housing and houses the developer; a first sealing member that is provided at both ends of a longitudinal direction of the developing roller and slidably contacts a circumferential surface of the developing roller for preventing leakage of the developer from the housing; a developer passage opening for passage of the developer provided in at least one of the housing and the developer cartridge; and a second sealing member provided in a vicinity of the developer passage opening for preventing leakage of the developer from the developer passage opening, at least a part of the second sealing member overlapping the first sealing member in a direction in which the developer cartridge is attachable to and detachable from the housing, wherein the second sealing member is arranged such that at least a portion of a shadow of the second sealing member cast in a direction, in which the developer passes through the developer passage opening, overlaps the first sealing member, and wherein the developer cartridge is attachable to and detachable from the housing at a position opposed to the developing roller with reference to the supply roller.

According to another aspect of the present invention, there is provided an image forming apparatus including: a developing device including: a housing; a developing roller that is rotatably provided in the housing and carries developer; a supply roller for supplying the developer to the developing roller; a developer cartridge that is attachable to and detachable from the housing and houses the developer; a first sealing member that is provided at both ends of a longitudinal direction of the developing roller and slidably contacts a circumferential surface of the developing roller for preventing leakage of the developer from the housing; a developer passage opening for passage of the developer provided in at least one of the housing and the developer cartridge; and a second sealing member provided in a vicinity of the developer passage opening for preventing leakage of the developer from the developer passage opening, at least a part of the second sealing member overlapping the first sealing member in a direction in which the developer cartridge is attachable to and detachable from the housing; and an image forming apparatus main body, wherein the developing device is attachable to and detachable from the image forming apparatus main body.

<Illustrative Aspects>

Illustrative aspects of the invention will be described with reference to the drawings.

In the related art, in order to prevent leakage of toner by the sealing material provided between the toner box and the first shutter and the sealing material provided between the case and the second shutter, the sealing materials may be compressed by pressing the toner box to the case when the toner box is attached to the case.

However, when the toner box is pressed against the case, surroundings of the toner inlet of the case and surroundings of the toner outlet of the toner box become bent. Thus, a sealing characteristic of the sealing materials may be deteriorated and the toner may be leaked.

Aspects of the present invention provide a developing device capable of preventing leakage of developer by reducing a degree of deformation in edges of developer passage openings in a housing by a simple configuration. Further, aspects of the present invention provide an image forming apparatus including the developing device.

(Image Forming Apparatus)

Figure 2:
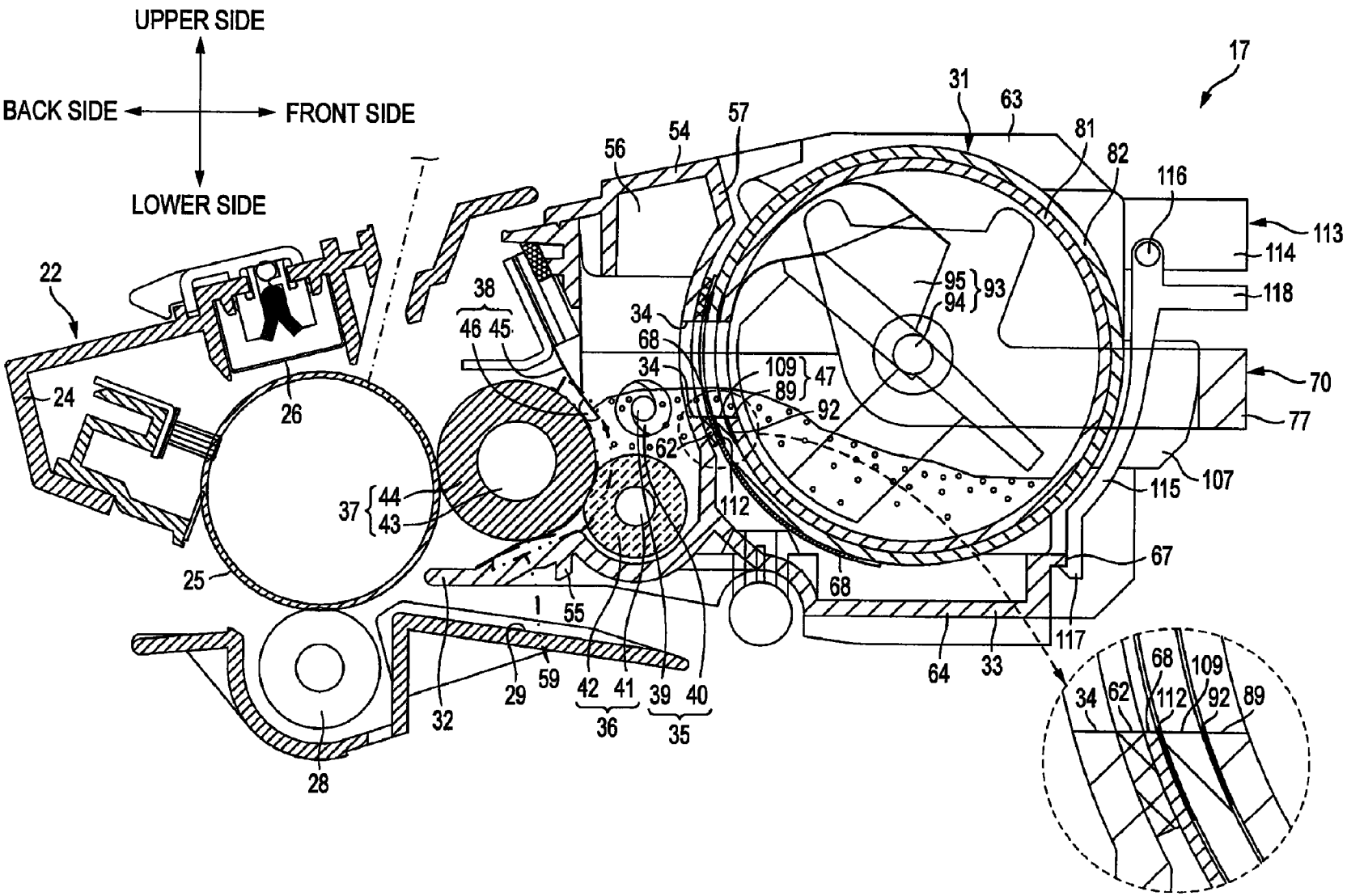
FIG. 2 is an exemplary side sectional view of a developing unit according to an aspect of the present invention wherein the developing unit is in a state in which a developer cartridge according to an aspect of the present invention is attached to a process frame.
Figure 3:
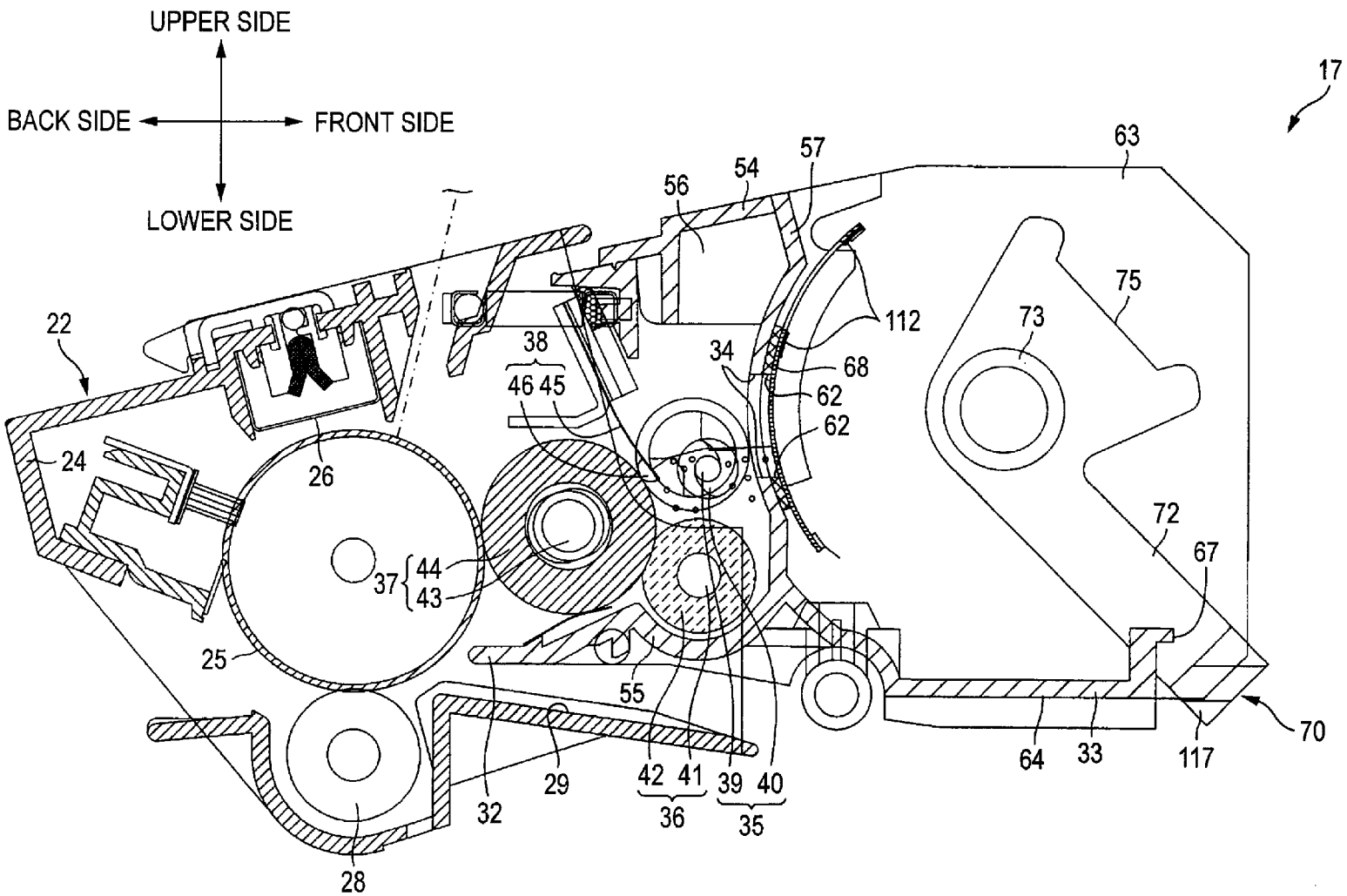
FIG. 3 is an exemplary side sectional view of the developing unit in a state in which the developer cartridge is detached from the process frame.

FIG. 1 is an exemplary side sectional view showing an image forming apparatus according to an aspect of the present invention. In FIG. 1, the image forming apparatus is embodied in the form of a laser printer by way of an example. However, one of ordinary skill in the art will appreciate that the present inventive concept will apply equally to any apparatus which uses developer for producing images on a recording medium. FIG. 2 is an exemplary side sectional view of a developing unit according to an aspect of the present invention wherein the developing unit is in a state in which a developer cartridge according to an aspect of the present invention is attached to a process frame. FIG. 3 is an exemplary side sectional view of the developing unit in a state in which the developer cartridge is detached from the process frame.

As shown in FIG. 1, the image forming apparatus 1 includes a feeder unit 4 for feeding a sheet 3, an image forming unit 5 for forming an image on the sheet 3, a sheet discharge part 6 for discharging the sheet 3 on which the image is formed, and a body casing 2 for housing the feeder unit 4, the image forming unit 5, and the sheet discharge part 6. The body casing 2 is one example of an apparatus body.

(1) Body Casing

The body casing 2 has a substantially box shape. An opening is provided in one sidewall of the body casing 2. A front cover 7 for opening or closing the opening is provided. A developing device 17 (described later) can be attached to or detached from the body casing 2 by opening the front cover 7.

Incidentally, in the following descriptions, the side of the body casing where the front cover 7 is provided is referred to as a front side (front face side), and an opposite side of the body casing is referred to as a back side (rear side). A side of FIG. 1 toward the viewer with respect to a thicknesswise direction of a sheet is referred to as a left side, and a side of FIG. 1 away from the viewer with respect to the same direction is referred to as a right side. Moreover, a horizontal direction (a right-to-left direction) is synonymous with a width direction.

The direction of the developing device 17 (described later) and the direction of the developer cartridge 31 (described later) are similarly described using directions in reference to the front side of the image forming apparatus 1.

(2) Feeder Unit

The feeder unit 4 includes a sheet feeding tray 9, a sheet feed roller 10, and a sheet feeding pad 11, paper dust removal rollers 12 and 13, a register roller 14, and a sheet pressing plate 15. The sheet 3 located at a top on the sheet pressing plate 15 is fed one at a time by the sheet feed roller 10 and the sheet feeding pad 11. After passing through various rollers 12 through 14, the sheet is conveyed to a transfer position (described later) on the image forming unit 5.

(3) Image Forming Unit

The image forming unit 5 includes a scanner unit 16, the developing device 17, and a fixing part 18. In FIG. 1, the developing device 17 is embodied in the form of a process cartridge by way of an example. However, one of ordinary skill in the art will appreciate that the present inventive concept will apply equally to any unit which may be used for developing.

(3-1) Scanner Unit

The scanner unit 16 is provided in an upper part of the body casing 2. The scanner unit includes a laser emission part (not shown), a polygon mirror 19 to be rotationally driven, a plurality of lenses 20, and a plurality of reflecting mirrors 21. As indicated by a chain line, a laser beam, which is emitted from the laser emission part and which is based on image data, is reflected by the polygon mirror 20 and passes through the plurality of lenses 20 and undergoes reflection on the plurality of reflecting mirrors 21, thereby scanning the surface of a photosensitive drum 25 of the developing device 17.

(3-2) Developing Device

The developing device 17 is disposed under the scanner unit 16. The developing device 17 is attachable to and detachable from the body casing 2.

As shown in FIG. 2, the developing device 17 includes a process frame 22 as one example of a housing and a developer cartridge 31. The process frame 22 includes a transfer path 29 for allowing passage of the sheet 3. The developer cartridge 31 is attachable to and detachable from a cartridge housing part 33 (described later) of the process frame 22.

The process frame 22 includes the photosensitive drum 25 as one example of photosensitive member, a scorotron-type charger 26, a transfer roller 28, a developing roller 37, a layer thickness regulating blade 38, a supply roller 36, and an auger 35.

The photosensitive drum 25 is rotatably supported by the process frame 22. While being spaced apart from the photosensitive drum 25, the scorotron-type charger 26 is supported by the process frame 22 above the photosensitive drum 25. The transfer roller 28 is disposed opposite from below the photosensitive drum 25 and rotatably supported by the process frame 22.

The developing roller 37 is disposed opposite and at the front of the photosensitive drum 25. The supply roller 36 is disposed opposite and at the front of the developing roller 37. The developing roller 37 and the supply roller 36 are rotatably supported by the process frame 22.

The layer thickness regulating blade 38 includes a leaf spring member 45 having a substantially thin plate shape, and pressure-contact rubber 46 provided at the lower end of the leaf spring member 45. The upper end of the leaf spring member 45 is fixed to the process frame 22, and the pressure-contact rubber 46 presses the surface of the developing roller 37 by an elastic force of the leaf spring 45.

The auger 35 includes an auger shaft 39 and a screw 40 provided around the auger shaft 39. The auger shaft 39 is provided along the width direction and is rotatably supported at a position above the supply roller 36.

An agitator 93 (described later) is provided in a developer cartridge 31 for housing developer. In the image forming apparatus 1 of the aspect, the developer comprises a suspension polymerization toner which is a nonmagnetic one-component toner with positive electrification.

The developer in the developer cartridge 31 is agitated by a rotation of the agitator 93 and discharged to a developing part (a developing chamber) 32 (described later) in the process frame 22 by way of a cartridge-side passage opening 47 (described later) and a frame-side passage opening 34 (described later). The discharged developer is supplied to the supply roller 36 while being conveyed, by a rotation of the auger 35, from the center to respective ends in the width direction. The developer having not been supplied to the supply roller 36 is returned to the inside of the developer cartridge 31 by way of the frame-side passage opening 34 and the cartridge-side passage opening 47. As a result, circulation of the developer between the developer cartridge 31 and the developing chamber 32 is ensured.

The developer supplied to the supply roller 36 is supplied to the developing roller 37 by a rotation of the supply roller 36. At this time, the developer is frictionally electrified with positive polarity between the supply roller 36 and the developing roller 37. Subsequently, the developer supplied to the developing roller 37 enters between the pressure-contact rubber 46 of the layer thickness regulating blade 38 and the developing roller 37 in conjunction with rotation of the developing roller 37, and is carried as a thin layer on the surface of the developing roller 37 while being regulated between the rubber and the roller in terms of a layer thickness.

After being uniformly electrified with positive polarity by the scorotron-type charger 26 along with rotation of the photosensitive drum 25, the surface of the photosensitive drum 25 is exposed to a laser beam emitted from the scanner unit 16, whereupon an electrostatic latent image based on image data is created. Subsequently, when the developer carried on the surface of the developing roller 37 comes into contact with the photosensitive drum 25 by a rotation of the developing roller 37, the electrostatic latent image created on the surface of the photosensitive drum 25 is supplied. As a result, the electrostatic latent image is developed (visualized), and the developer image is carried on the surface of the photosensitive drum 25. The developer image is transferred onto the sheet 3 conveyed (to a position) between the photosensitive drum 25 and the transfer roller 28.

(3-3) Fixing Part

As shown in FIG. 1, the fixing part 18 is provided at the back of the developing device 17. The fixing part 18 includes a heating roller 48, a pressurizing roller 49 brought into intimate contact with the heating roller 48 from below, and a pair of conveyor rollers 50 disposed at the back of these rollers.

The fixing part 18 thermally fixes the developer transferred on the sheet 3 at the transfer position during the course of the sheet 3 being passing between the heating roller 48 and the pressurizing roller 49. Subsequently, the sheet 3 is conveyed to the sheet discharge part 6 by the pair of conveyor rollers 50.

(4) Sheet Discharge Part

The sheet discharge part 6 includes a sheet discharging path 51, a sheet discharging roller 52, and a sheet discharging tray 53. The sheet 3 conveyed from the fixing part 18 to the sheet discharging path 51 is conveyed from the sheet discharging path 51 to the sheet discharging roller 52, and the sheet is discharged onto the sheet discharging tray 53 by the sheet discharging roller 52.

(Developing Device)

Figure 4:
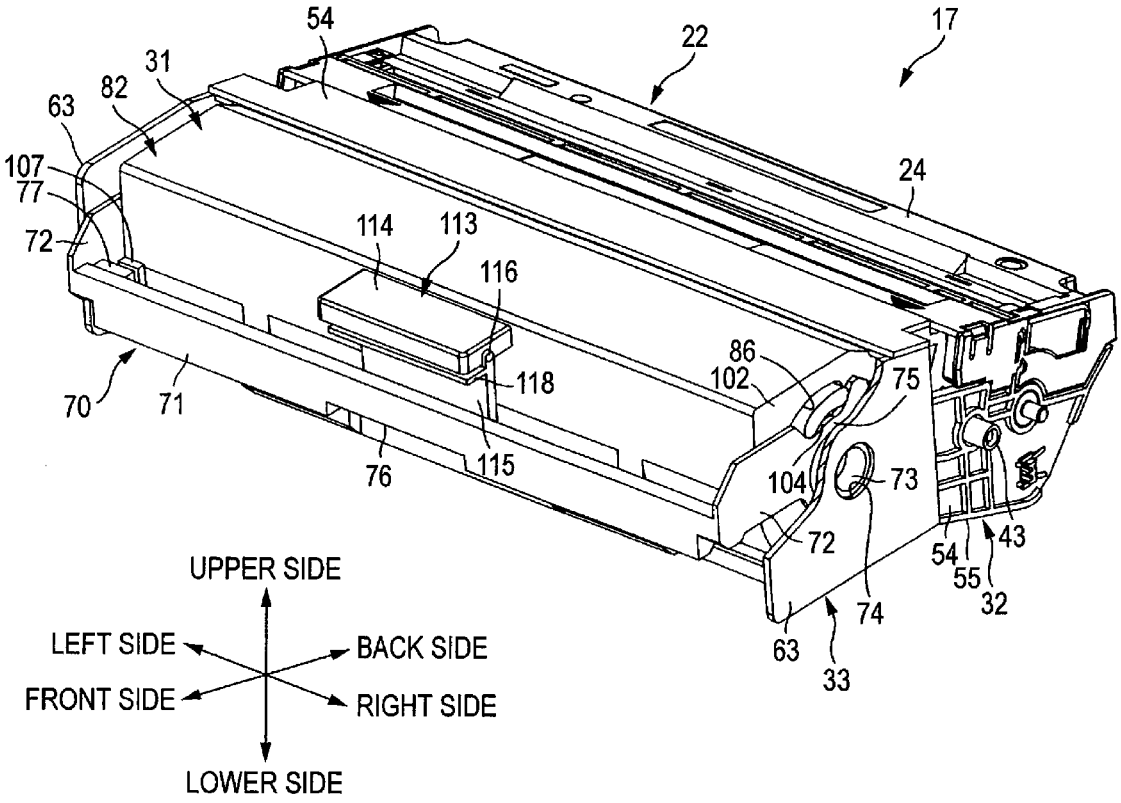
FIG. 4 is a schematic perspective view of the developing unit of FIG. 2 as viewed from a front right side of the developing unit.
Figure 5:
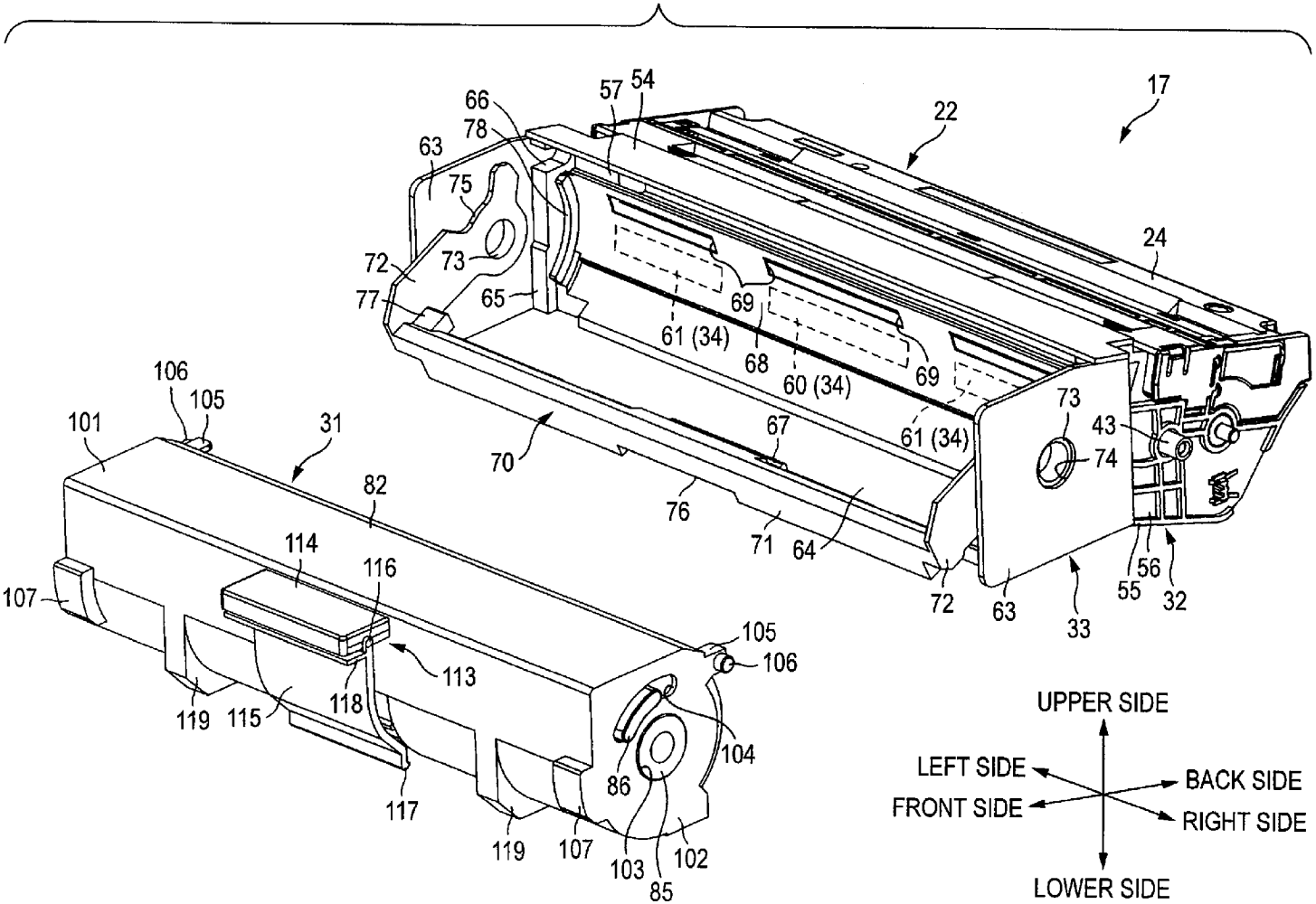
FIG. 5 is an exemplary perspective view, as viewed from the front right side of the developing unit of FIG. 4, showing the developing unit in a state in which the developer cartridge is detached from the process frame.
Figure 6:
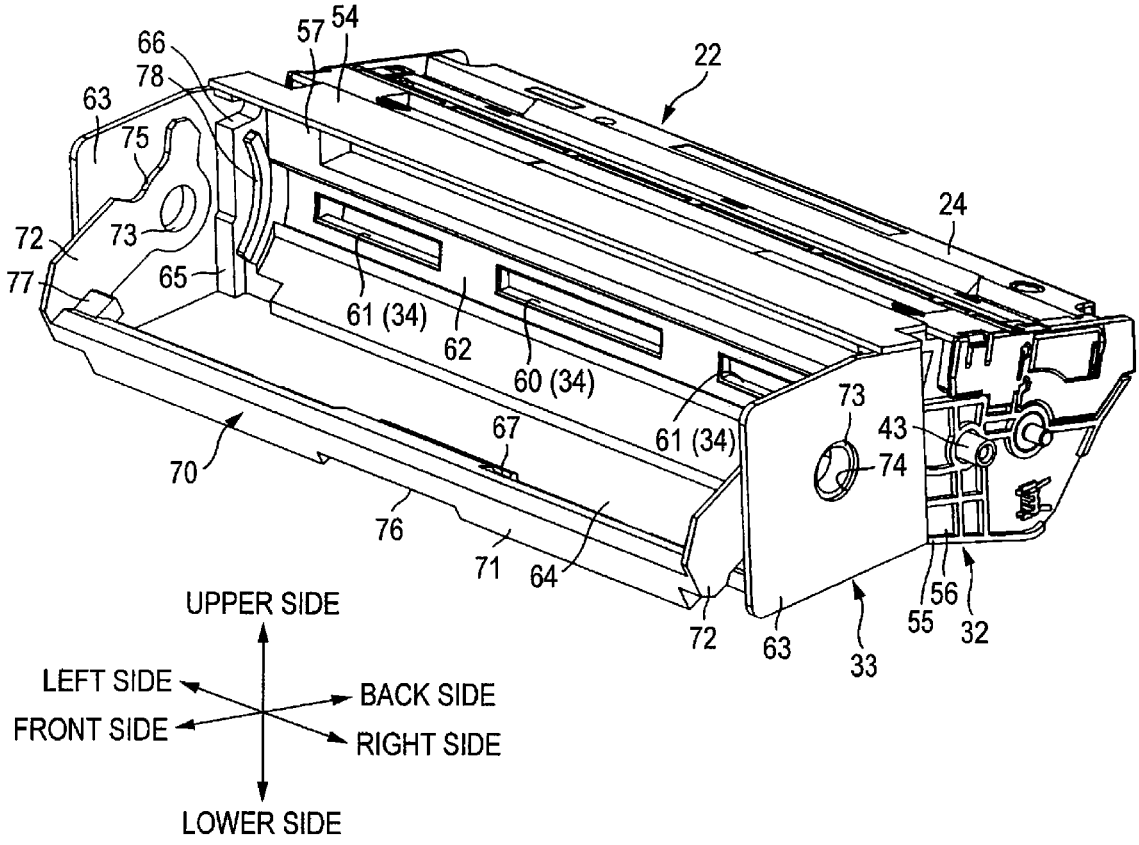
FIG. 6 is a schematic perspective view of the developing unit as viewed from the front right side of the developing unit.
Figure 7:
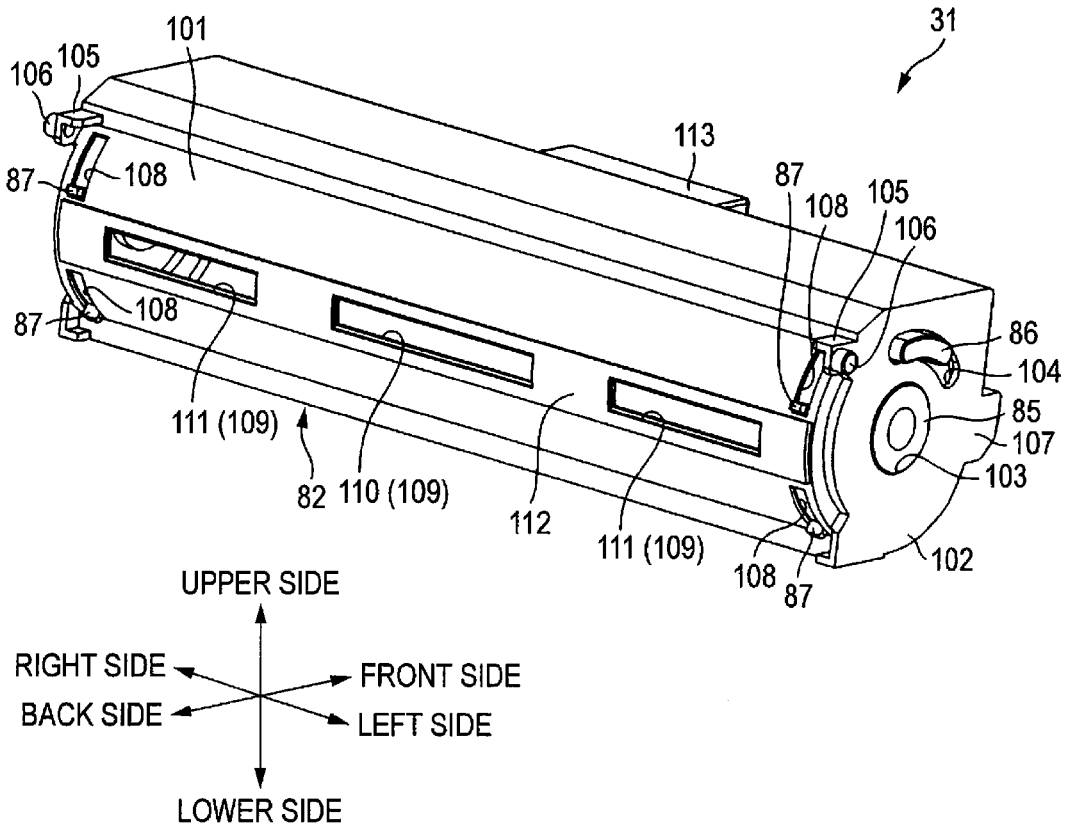
FIG. 7 is an exemplary perspective view of the developer cartridge of FIG. 5, as viewed from a back left side, in a state in which a cartridge-side shutter is opened.
Figure 8:
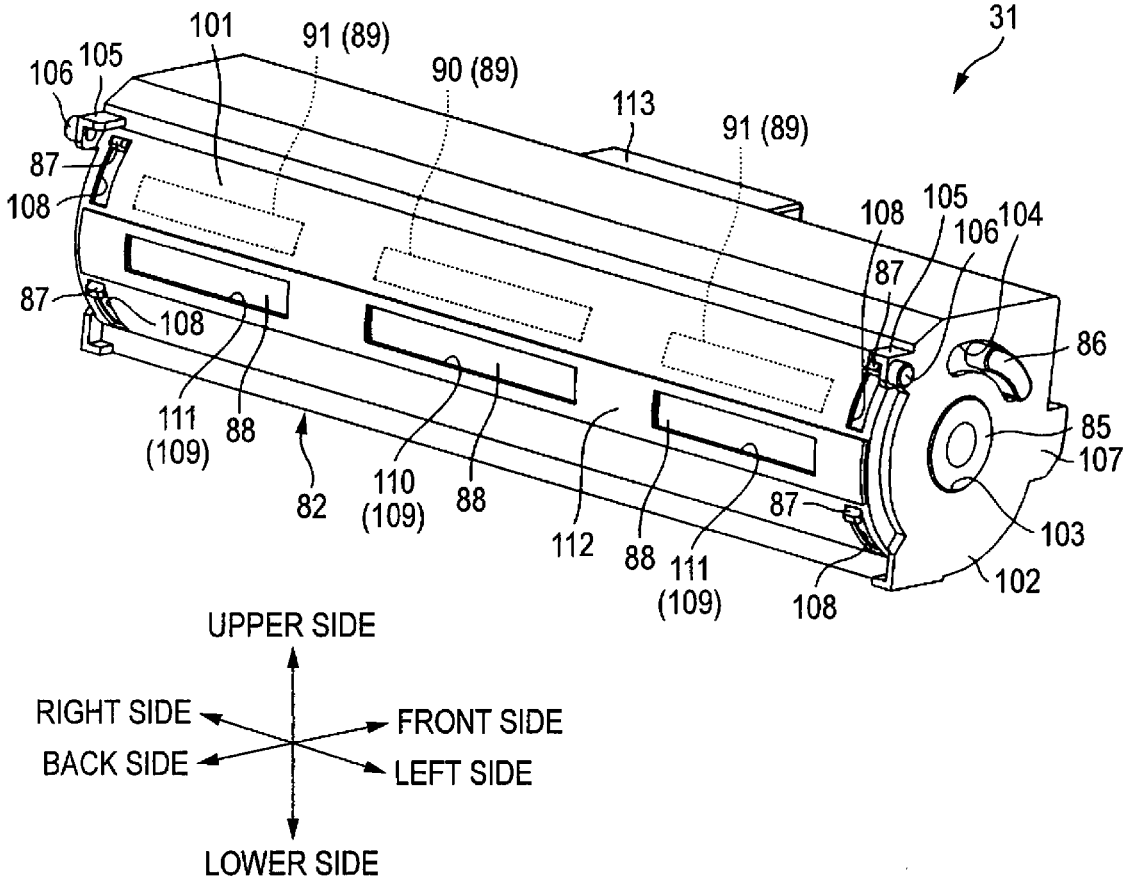
FIG. 8 is an exemplary perspective view of the developer cartridge of FIG. 5, as viewed from the back left side, in a state in which the cartridge-side shutter is closed.
Figure 9:
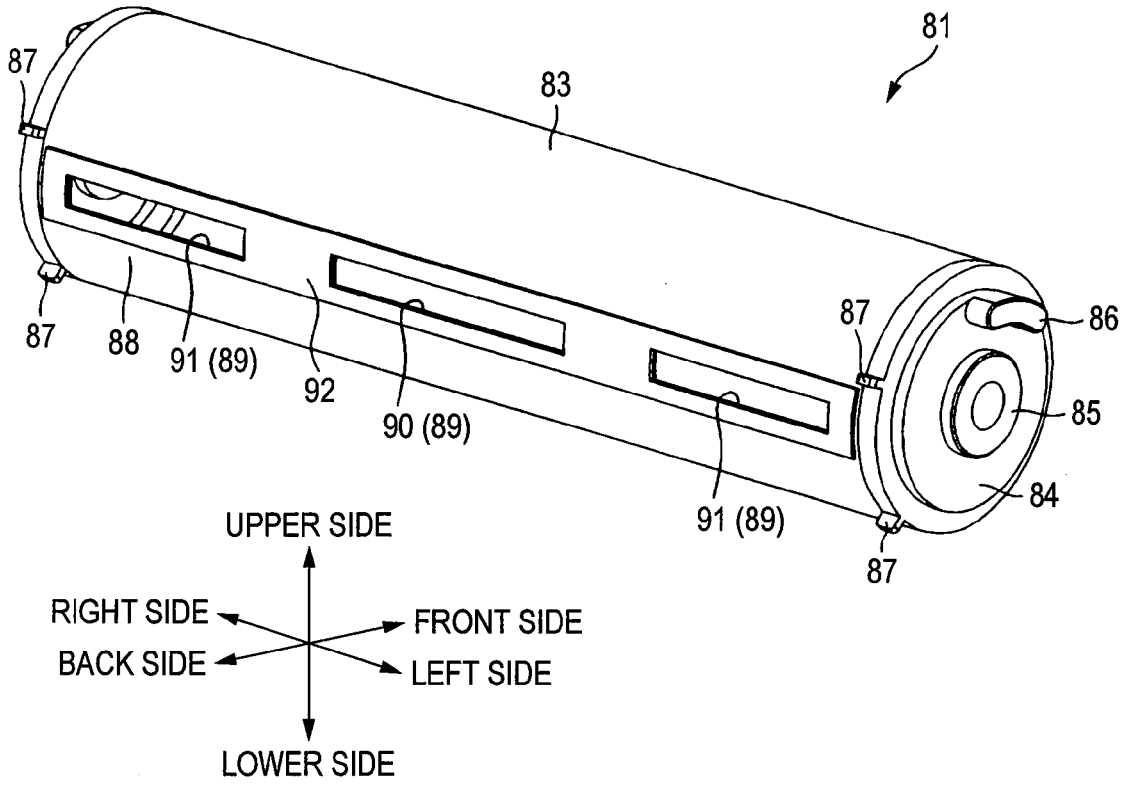
FIG. 9 is an exemplary perspective view of an inside housing of the developer cartridge of FIG. 5, as viewed from the back left side.
Figure 10:
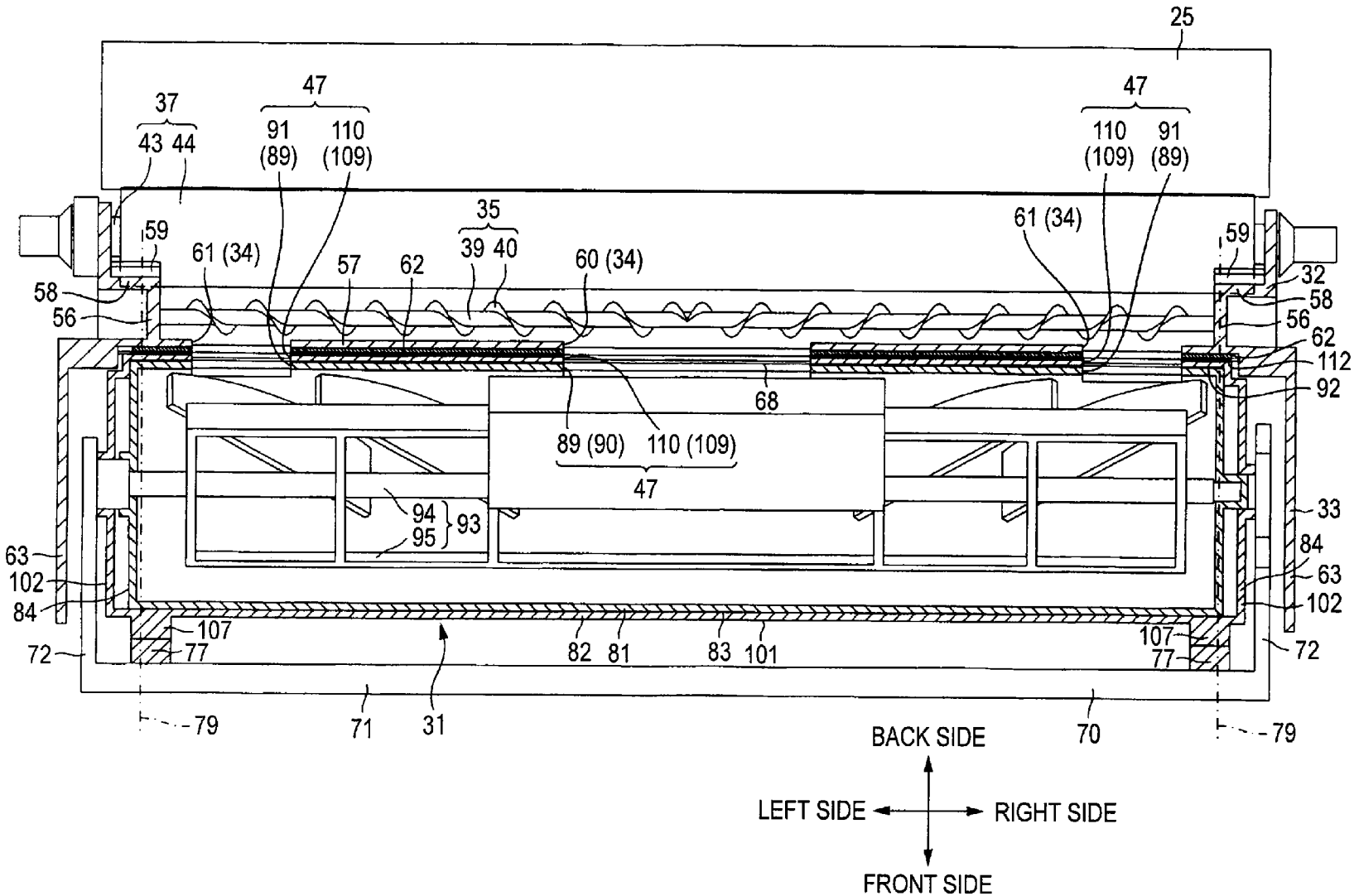
FIG. 10 is an exemplary plan sectional view of a developing part.
Figure 11:
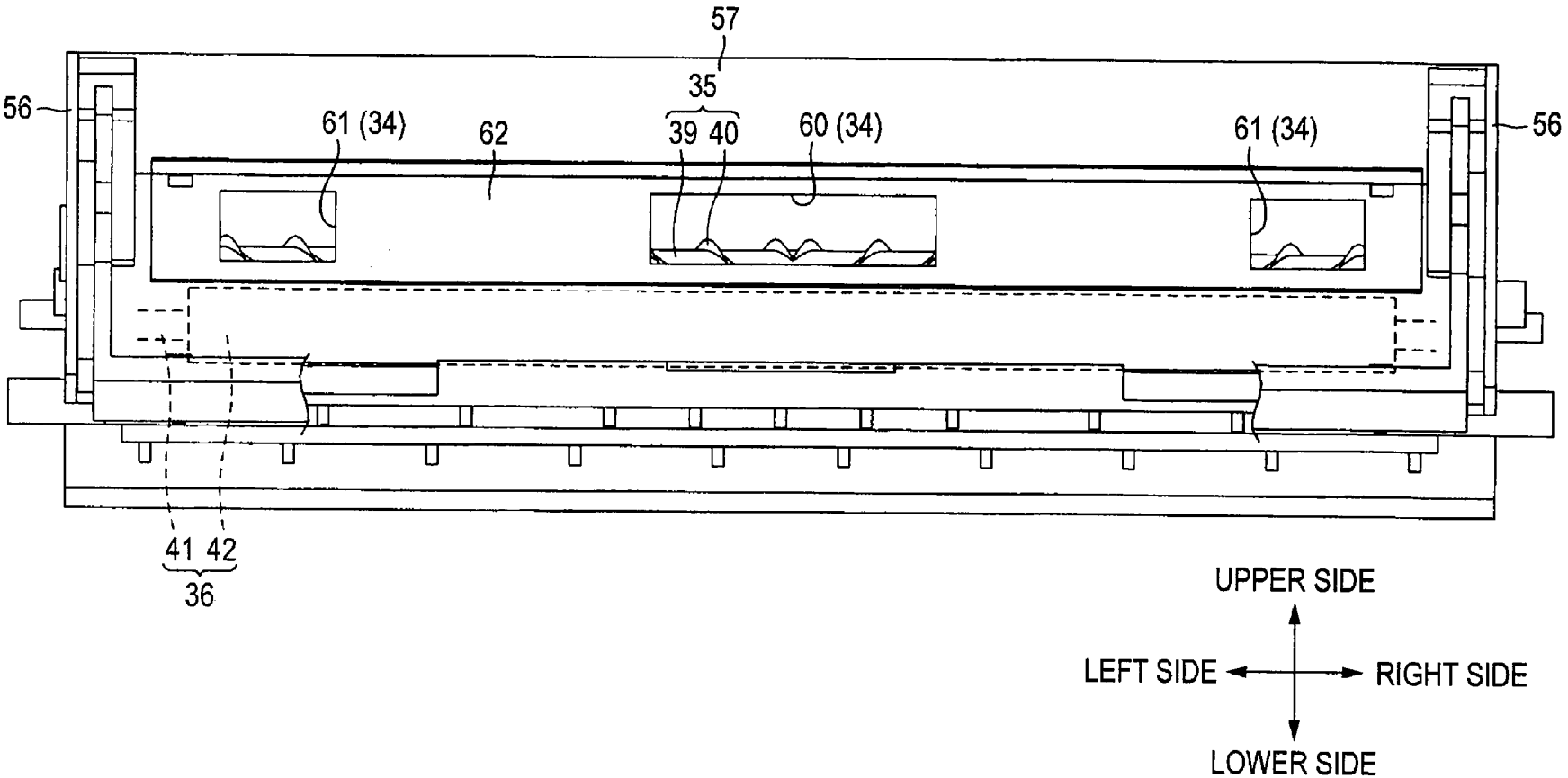
FIG. 11 is a schematic front view of the developing unit.

FIG. 4 is a schematic perspective view of the developing unit of FIG. 2 as viewed from a front right side of the developing unit. FIG. 5 is an exemplary perspective view, as viewed from the front right side of the developing unit of FIG. 4, showing the developing unit in a state in which the developer cartridge is detached from the process frame. FIG. 6 is a schematic perspective view of the developing unit as viewed from the front right side of the developing unit. FIG. 7 is an exemplary perspective view of the developer cartridge of FIG. 5, as viewed from a back left side, in a state in which a cartridge-side shutter is opened. FIG. 8 is an exemplary perspective view of the developer cartridge of FIG. 5, as viewed from the back left side, in a state in which the cartridge-side shutter is closed. FIG. 9 is an exemplary perspective view of an inside housing of the developer cartridge of FIG. 5, as viewed from the back left side. FIG. 10 is an exemplary plan sectional view of a developing part. FIG. 11 is a schematic front view of the developing unit.

(a) Process Frame

The process frame 22 integrally includes the photosensitive drum 25, a drum part 24 supporting the scorotron-type charger 26 and the transfer roller 28, the developing roller 37, the supply roller 36, a developing part 32 supporting the layer thickness regulating blade 38 and the auger 35, and a cartridge storage part 33. The developer cartridge 31 is attachable to and detachable from the developer cartridge.

(a-1) Developing Part

As shown in FIGS. 3 and 5, the developing part 32 integrally includes an upper wall 54, a bottom wall 55, sidewalls 56, and a front wall 57. Both sidewalls 56 are disposed so as to oppose each other while being spaced apart from each other in the width direction. Each of the sidewalls 56 is arranged along a longitudinal direction.

The supply roller 36 is equipped with a supply roller shaft 41 and a sponge roller 42 provided around the supply roller shaft 41. The developing roller 37 includes a developing roller shaft 43 and a rubber roller 44 provided around the development roller shaft 43.

As shown in FIG. 10, each of the sidewalls 56 of the developing part 32 is provided with a receiving part 58 for receiving the rubber roller 44 of the developing roller 37. Specifically, a rear portion of each of the sidewalls 56 for supporting the developing roller shaft 43 is formed so as to become wider as compared with a front portion of the sidewall that supports the auger shaft 39 and the supply roller shaft 41. Each of the receiving parts 58 is formed as a step between the rear portion and the front portion of the sidewall so as to extend in the width direction. Specifically, each of the receiving parts 58 extends from a rear edge of the front portion to the outside in the width direction and is connected to a front edge of the rear portion. Further, each of the receiving parts 58 has a substantially curved shape conforming to a front-side peripheral surface of the rubber roller 44 as viewed from the side.

In order to prevent leakage of developer from the process frame 22, each of the receiving parts 58 is provided with a side seal 59 as an example of the first sealing member.

As shown in FIGS. 2 and 10, the side seal 59 is affixed to the surface of each of the receiving parts 58 from up to down so as to come into contact with a front-side peripheral surface of the rubber roller 44 that extends from a front lower surface to a front upper surface thereof.

The side seals 59 are formed from an elastic foaming material such as high density microcell urethane foam. A felt material formed from such as Teflon (registered trademark) felt, is affixed to the surface of the elastic foam material in order to enhance ease of sliding.

Peripheral surfaces of both axial ends of the rubber roller 44 remain in intimate contact with the respective side seals 59.

Thereby, the developing roller shaft 43 is rotatably supported by the rear portions of both sidewalls 56 while the peripheral surfaces of both axial ends of the rubber roller 44 are being slidably brought into contact with both side seals 59, whereby the developing roller 37 is supported by the process frame 22.

The supply roller shaft 41 is rotatably supported by the front portions of both respective sidewalls 56 at the front side of the developing roller 37, whereupon the supply roller 36 is supported by the process frame 22.

An auger shaft 35 is rotatably supported by the front portions of both respective sidewalls 56 above the supply roller 36, whereupon the auger 35 is supported by the process frame 22.

As shown in FIG. 2, the front wall 57 includes a curved portion in the middle of the upper and lower directions. The curved portion of the front wall 57 has a radius of curvature that matches an outer peripheral surface of the developer cartridge 31.

As shown in FIG. 6, the frame-side passage opening 34 as an example of the developer passage opening is formed in the curved portion of the front wall 57.

Specifically, the frame-side passage opening 34 is formed in number of three while being spaced, at an interval, apart from each other in the width direction. Each of the frame-side passage openings 34 has a substantially rectangular shape elongated in the width direction. Of the frame-side passage openings 34, the frame-side passage opening 34 formed in the center of the front wall 57 in the width direction thereof is taken as a frame-side supply opening 60, and the frame-side passage openings 34 on both sides of the frame-side supply opening 60 in the width direction are taken as frame-side return openings 61.

As shown in FIG. 11, outer side edges of the width direction of the frame-side return openings 61 are located inside (positions closer to the center in the width direction) in the width direction when compared with outer side edges of the sponge roller 42 of the supply roller 36.

A frame-side seal 62 as an example of the second sealing member for preventing leakage of developer from the frame-side passage openings 34 is provided on the curved portion of the front wall 57 around the edges of the frame-side passage openings 34.

The frame-side seal 62 is formed, from an elastic material such as felt, in the form of a strip extending in the width direction. Cutouts corresponding to the respective frame-side passage openings 34 are formed in the frame-side seal 62. The frame-side seal 62 is affixed to a position, which is located intermediate with respect to the vertical direction of the front wall 57, along the width direction in such a way that the respective cutouts oppose the respective frame-side passage openings 34.

As a result, the frame-side seal 62 is provided on the surface (a front) of the curved portion of the front wall 57 so as to cover the edges of the respective frame-side passage openings 34 and become continuous among the respective frame-side passage openings 34.

As shown in FIG. 10, both ends of the width direction of the frame-side seal 62 are arranged in such a way that portions of shadows of these ends cast in the longitudinal direction (a direction in which developer passes through the frame-side passage openings 34) overlap the respective side seals 59. Specifically, as indicated by a dashed line 79, the respective ends of the frame-side seal 62 are arranged in such a way that the portions of the shadows of these ends cast in the longitudinal direction overlap the inner portions of the width direction of the respective side seals 59.

(a-2) Cartridge Housing Part

As shown in FIG. 5, the cartridge housing part 33 includes side plates 63 and a bottom plate 64. The side plates 63 and the bottom plate 64 of the cartridge housing part 33 are formed integrally so as to become continual from the bottom wall 55 and both side walls 56 of the developing part 32.

Shutter support parts 65 are provided on inner side walls of the width direction of both side plates 63. The shutter support parts 65 having a substantially rectangular shape extending from the inner side walls of the width direction of the side plates 63 to the inside, and are provided so as to vertically extend from the rear ends of the side plates 63.

A shutter guide part 78 is provided on the inner side surface of the width direction of each of the shutter support parts 65. Each of the shutter guide parts 78 forms a convex line which bulges from the inner side surface of the width direction of the shutter support part 65 to the inside, and is disposed opposite the curved portion of the front wall 57 with a nominal space therebetween in the longitudinal direction. Each of the shutter guide parts 78 has a substantially curved shape having substantially the same curvature as that of the curved portion of the front wall 57.

The upper end surface of each of the shutter support parts 65 is positioned lower than the upper edge of each of the side plates 63 to some extent. The upper end surfaces of the respective shutter support parts 65 are taken as upper fixed parts 66.

A lower fixing part 67 that slightly projects to the front with a rectangular shape as viewed from the top is formed in the center portion of the width direction of the front edge of the bottom plate 64.

A shutter 68 for closing and opening the frame-side passage openings 34 is provided in the cartridge housing part 33.

The shutter 68 has a substantially rectangular plate shape extending in the width direction and has a substantially curved shape having substantially the same curvature of the curved portion of the front wall 57. The shutter 68 extends between the shutter guide parts 78 in the width direction. Three shutter opening parts 69 capable of opposing the respective frame-side passage openings 34 in a one-to-one relationship are formed in the shutter 68.

The shutter 68 is disposed opposite the curved portion of the front wall 57, and both ends of the width direction of the shutter 68 are slidably sandwiched between the front wall 57 and the respective shutter guide parts 78.

As a result, the shutter 68 is supported along the respective shutter guide parts 78, in a vertically swayable manner, between an open position (see FIG. 2) where the frame-side passage openings 34 are opened and a close position (see FIG. 3) where the frame-side passage openings 34 are closed.

The cartridge housing part 33 is provided with a pivotal arm 70. The pivotal arm 70 has a substantially U-shaped as viewed from the top. The pivotal arm 70 integrally includes a grip rod 71 extending in the width direction and arm side plates 72 extending from both ends of the width direction of the grip rod 71 backwards.

A boss 73 protruding to the outside in the width direction is provided on a rear end portion of each of the arm side plates 72. Each of the bosses 73 is rotatably supported by a round hole 74 formed in each of the side plates 63.

An acceptance recess 75 cut so as to form a hollow downwardly is formed in an upper side edge of a rear end portion of each of the arm side plates 72.

An inwardly-depressed grip part 76 is provided in a center portion of the grip rod 71 in a width direction thereof. A pressing projection 77 is provided as an example of a pressing member, which bulges backwardly and assumes a rectangular shape as viewed from the rear, at either end of the width direction of the grip rod 71.

The pressing projections 77 are arranged so as to overlap at least portions of the cast shadows of the side seals 59 in the longitudinal direction (see the dashed line 79 shown in FIG. 10).

While taking the bosses 73 of the respective arm side plates 72 as fulcrums, the pivotal arm 70 sways between a press release position (see FIG. 3) where the lower edges of the respective arm side plates 72 come into contact with a front edge of the bottom plate 64 and a press position (see FIG. 2) where the developer cartridge 31 is pressed from the front when the developer cartridge 31 is housed in the cartridge housing part 33.

(b) Developer Cartridge

As shown in FIGS. 7 through 9, the developer cartridge 31 includes an inside housing 81 for storing developer and an outside housing 82 for housing the inside housing 81.

(b-1) Inside Housing

As shown in FIG. 9, the inside housing 81 integrally includes a cylindrical inner peripheral wall 83 extending in the width direction and an inner sidewall 84 of a disk shape which closes both ends of the width direction of the inner peripheral wall 83.

A boss part 85, which bulges in a width direction and which assumes the shape of a thick plate disc, is provided in the center of each of inner side walls 84.

A slide projection 86 is provided at an upper portion of each of the inner sidewall 84 and at the radially outside of the boss part 85. The slide projection 86 has a substantially circular-arc shape (the shape of a circular arc having a center angle of about 60°) that matches an outer peripheral surface of the inner sidewall 84. The slide projection 86 protrudes from the inner sidewall 84 to the outside in the width direction.

A pair of nipping projections 87 radially protrude from a peripheral end face of a rear portion of each inner sidewall 84. The pair of nipping projections 87 are disposed on the peripheral end face of each inner sidewall 84 while being spaced apart from each other at an interval (corresponding to the peripheral length of the shutter 68) in the circumferential direction.

In an enclosed area 88 of the inner peripheral wall 83, which is enclosed by the pairs of nipping projections 87 disposed both axial ends of the inner peripheral wall (i.e., the four nipping projections 87), there are formed inner passage openings 89 as examples of the cartridge-side passage openings 47 that are developer passage openings.

The inner passage openings 89 are formed in an upper portion of the enclosed area 88. The inner passage openings 89 are specifically formed in number of three while being spaced apart from each other in a width direction. Each of the inner passage openings 89 is formed into a rectangular shape which is elongated in the width direction. Of the inner passage openings 89, the inner passage opening 89 formed in the center position of the width direction is taken as an inner supply opening 90, and the inner passage openings 89 formed on both sides of the inner supply opening 90 in the width direction are taken as inner return openings 91.

When the developer cartridge 31 is attached to the process frame 22, the inner supply opening 90 opposes the frame-side supply opening 60, and the two inner passage openings 89 oppose the two frame-side return openings 61.

An inner seal 92 as an example of the second sealing member for preventing leakage of developer from the inner passage openings 89 along edges thereof is provided at an upper portion of the enclosed area 88.

The inner seal 92 is formed from an elastic material, such as felt, into the shape of a strip extending in the width direction, and cutouts are formed so as to correspond to the respective inner passage openings 89. The inner seal 92 is affixed to the upper portion of the enclosed area 88 along a width direction in such a way that the respective cutouts oppose the respective inner passage openings 89.

As a result, the inner seal 92 is provided on the surface (a circumferential surface) of the upper portion of the enclosed area 88 so as to cover the edges of the respective inner passage openings 89 and become continuous among the respective inner passage openings 89.

As indicated by the dashed line 79 shown in FIG. 10, when the developer cartridge 31 is attached to the process frame 22, both ends of the width direction of the inner seal 92 are arranged in such a way that portions of shadows of the ends cast in the longitudinal direction overlap the respective side seals 59. Specifically, the respective ends of the inner seal 92 are arranged in such a manner that portions of the shadows of the ends cast in the longitudinal direction overlap the inner portions of the width direction of the respective side seals 59.

An agitator 93 is provided within the inside housing 81. The agitator 93 includes an agitator shaft 94 extending in the width direction and agitating vanes 95 radially extending from the agitator shaft 94 to the outside. The agitator shaft 94 is rotatably supported by both inner sidewalls 84 and rotated by a driving force from a motor (not shown) during formation of an image.

(b-2) Outside Housing

In order to rotatably house the inside housing 81, the outside housing 82 is formed so as to become slightly larger than the inside housing 81 in both the width direction and the radial direction. As shown in FIG. 8, the outside housing 82 integrally includes an outer peripheral wall 101 extending in the width direction and an outer sidewall 102 that closes both ends of the width direction of the outer peripheral wall 101. The outer peripheral wall 101 has a substantially cylindrical shape. The outer sidewall 102 has a substantially disc shape.

An outer peripheral surface of the upper portion and upper front portion of the outer peripheral wall 101 has a substantially planar shape. In contrast, an inner peripheral surface of the outer peripheral wall 101 has a substantially circular cross-sectional shape.

A circular boss hole 103 for accepting the boss part 85 is formed in each of the outer sidewalls 102. Further, a slide hole 104 into which the slide projection 86 is to be inserted is formed in an upper portion of each of the outer sidewalls 102. The slide holes 104 are arranged so as to oppose the slide projections 86 in the width direction. Each of the slide holes 104 has a substantially circular-arc shape (the shape of a circular arc having a center angle of about 45°), which is longer than the slide projection 86, as viewed from sideways.

A rearwardly-protruding upper fixing part 105 is formed at an upper rearward position along the peripheral end face of each of the outer sidewalls 102. A positioning boss 106 protruding to the outside in the width direction is provided at a rear end portion of each upper fixing part 105.

As shown in FIG. 5, a forwardly-protruding part 107 to be pressed (hereinafter called a "press part") is provided at a lower front portion of the peripheral end face of each outer sidewall 102. The press part 107 has a substantially rectangular shape as viewed from the front. Further, the press part 107 has a substantially circular-arc shape as viewed from sideway so as to extend from the front center of each outer sidewall 102 to a lower portion thereof.

As shown in FIG. 8, the outer peripheral wall 101 includes four elongated holes 108 at both ends of the width direction thereof. The pairs of nipping projections 87 (i.e., the four nipping projections 87) are inserted to the elongated holes 108. The respective elongated holes 108 are arranged so as to oppose the respective nipping projections 87 in the radial direction. Each of the elongated holes 108 has a substantially rectangular shape extending in the vertical direction as viewed from the rear. As will be described later, each of the elongated holes 108 has a length equivalent to a pivotal range between the open position and the close position of the shutter 68.

Outer passage openings 109 are formed between the four elongated holes 108 (i.e., a space between the two upper elongated holes 108 and the two lower elongated holes 108) on the outer peripheral wall 101. The outer passage openings 109 are examples of the cartridge-side passage openings 47 as the developer passage openings.

The outer passage openings 109 are formed in number of three while being spaced apart from each other in the width direction. Each of the outer passage openings 109 has a substantially rectangular shape elongated in the width direction. Of the outer passage openings 109, the outer passage opening 109 formed in the center position of the width direction is taken as an outer supply opening 110, and the outer passage openings 109 formed on both sides of the outer supply opening 110 in the width direction are taken as outer return openings 111.

When the developer cartridge 31 is attached to the process frame 22, the outer supply opening 110 opposes the frame-side supply opening 60, and the two outer return openings 111 oppose the two frame-side return openings 61.

An outer seal 112 as one example of the second sealing member for preventing leakage of developer from the outer passage openings 109 along edges thereof is provided on the outer peripheral wall 101.

The outer seal 112 is formed from an elastic material, such as felt, into the shape of a strip extending in the width direction, and cutouts are formed so as to correspond to the respective outer passage openings 109. The outer seal 112 is affixed to the outer peripheral wall 101 along the width direction thereof in such a way that the respective cutouts oppose the respective outer passage openings 109.

As a result, the outer seal 112 is provided on the surface (a circumferential surface) of the outer peripheral wall 101 so as to cover the edges of the respective outer passage openings 109 and become continuous among the respective outer passage openings 109.

As indicated by the dashed line 79 shown in FIG. 10, when the developer cartridge 31 is attached to the process frame 22, both ends of the width direction of the outer seal 112 are arranged in such a way that portions of shadows of the ends cast in the longitudinal direction overlap the respective side seals 59. Specifically, the respective ends of the outer seal 112 are arranged in such a manner that portions of the shadows of the ends cast in the longitudinal direction overlap the inner portions of the width direction of the respective side seals 59.

As shown in FIG. 5, a grip part 113 is provided in the center portion of the front side of the outer peripheral wall 101 in the width direction.

The grip part 113 includes an upper grip plate 114 which projects from an upper side to a front side of the outer peripheral wall 101 and a latch arm 115 which extends from the upper grip plate 114 downwardly. The upper grip plate 114 has a substantially rectangular shape. The latch arm 115 has a substantially J-shape as viewed from sideway. An upper end of the latch arm 115 is supported, in a swayable manner, by a support shaft 116 provided on the upper grip plate 114. A latch claw 117 to be latched to the lower fixing part 67 is provided on a lower end of the latch arm 115. A lower grip plate 118 projecting to the front and having a substantially rectangular shape is provided in the vicinity of the upper end of the latch arm 115. The lower grip plate 118 is arranged so as to extend in parallel to the upper grip plate 114 while being spaced apart from the upper grip plate 114.

A compression spring (not shown) for pressing the upper grip plate 114 and the lower grip plate 118 in a direction where they depart from each other is interposed between the grip plates.

Downwardly-extending ribs 119 are provided on the front of the outer peripheral wall 101 and between the grip part 113 and the press part 107.

(b-3) Arrangement of Inside Housing and Outside Housing

The inside housing 81 is housed in the outside housing 82 in a rotatable manner.

Specifically, an outer circumferential surface of the inner peripheral wall 83 is fitted to an inner circumferential surface of the outer peripheral wall 101 so as to be slidable in a circumferential direction. Although not illustrated, outer circumferential surfaces of both inner side walls 84 are fitted to inner circumferential surfaces of both outer sidewalls 102 so as to be slidable in the circumferential direction. The boss parts 85 are supported by the boss holes 103 in a rotatable manner. The slide projections 86 are inserted into the corresponding slide holes 104. The respective nipping projections 87 are inserted into the respective elongated holes 108 and project to the radial outside from the respective elongated holes 108.

The inside housing 81 is allowed to make relative rotation with respect to the outside housing 82 between a close position (see FIG. 8) where the inner passage openings 89 do not oppose the outer passage openings 109 and an open position (see FIG. 7) where the inner passage openings 89 oppose the outer passage openings 109 while taking the boss parts 85 as fulcrums.

As shown in FIG. 8, when the inside housing 81 is located at the close position, the respective slide projections 86 are arranged at the front ends of the respective slide holes 104, and the respective nipping projections 87 are arranged at upper ends of the respective elongated holes 108. The inner passage openings 89 are arranged at positions higher than the outer passage openings 109, and the outer passage openings 109 are closed by a lower portion of the enclosed area 88.

The inside housing 81 is rotated relatively to the outside housing 82 in a direction (a downward direction) where the inner passage openings 89 move toward the outer passage openings 109 while the boss parts 85 are taken as fulcrums. The respective slide projections 86 make sliding movements within the respective slide holes 104 from the front ends to the rear ends thereof, and the respective nipping projections 87 make sliding movements within the respective elongated holes 108 from the upper ends to the lower ends thereof.

Subsequently, when the respective slide projections 86 come into contact with the rear edges of the respective slide holes 104 and when the respective nipping projections 87 come into contact with the lower edges of the respective elongated holes 108, the inside housing 81 comes to the open position as shown in FIG. 7.

When the inside housing 81 is arranged at the open position, the respective slide projections 86 are positioned at the rear ends of the respective slide holes 104, and the respective nipping projections 87 come to the lower ends of the respective elongated holes 108. The inner passage openings 89 oppose the outer passage openings 109 and these passage openings communicate with each other.

When the inside housing 81 is rotated relatively to the outside housing 82 in a direction (an upward direction) where the inner passage openings 89 depart from the outer passage openings 109 while the boss parts 85 are taken as fulcrums. As a result, the respective slide projections 86 come into contact with the front edges of the respective slide holes 104, and the respective nipping projections 87 come into contact with the upper edges of the respective elongated holes 108. As shown in FIG. 8, the inside housing 81 is put to the close position.

(c) Attachment and Detachment of Developer Cartridge to and from Process Frame (c-1) Attachment of the Developer Cartridge to Process Frame As shown in FIG. 5, in order to attach the developer cartridge 31 to the process frame 22, the upper grip plate 114 and the lower grip plate 118 are grasped against restoration force of a compression spring (not shown) in a direction where the upper and lower grip plates approach each other, thereby attaching the developer cartridge 31 (the developer cartridge 31 in which the inside housing 81 is put in the close position) to the cartridge housing part 33 (i.e., the cartridge housing part 33 in which the shutter 68 is placed at the close position and in which the pivotal arm 70 is put in the press release position).

Specifically, the respective positioning bosses 106 are put on the respective upper fixing parts 66, and the pair of both nipping projections 87 of the width direction nip upper and lower edges of both ends of the width direction of the shutter 68. The developer cartridge 31 is put on the bottom plate 64 in such a way that respective slide projections 86 are fitted into the respective acceptance recess parts 75.

Subsequently, grasping of the upper grip plate 114 and the lower grip plate 118 is released, whereby the latch arm 115 is swayed by a restoration force of the compression spring. As shown in FIG. 2, the latch claw 117 is latched to the lower fixing part 67, whereupon the developer cartridge 31 is housed in the cartridge housing part 33.

Since the positioning bosses 106 are put on the upper fixing parts 66 and the latch claw 117 is engaged with the lower fixing part 67, the outside housing 82 is fixed to the cartridge housing part 33.

The pivotal arm 70 is swayed from the press release position to the press position. As shown in FIG. 2, the respective pressing projections 77 press the respective press parts 107 in the rearward direction. As a result, the developer cartridge 31 is pressed toward the developing part 32. As indicated by the dashed line 79 shown in FIG. 10, the respective pressing projections 77 press, in the longitudinal direction, overlaps among the side seal 59, the frame-side seal 62, the inner seal 92, and the outer seal 112 by the pressing action.

As a result of the pivotal arm 70 being swayed from the press release position to the press position, the respective slide projections 86 fitted to the respective acceptance recess parts 75 make rearward sliding movements within the respective slide holes 104 along with swaying action of the respective side plate arms 72, to thus come to the rear ends of the respective slide holes 104. In association with the sliding action, the pair of nipping projections 87 provided at both ends in the width direction make downward sliding movements within the respective elongated holes 108 while holding the shutter 68, to thus come to the lower ends of the respective elongated holes 108.

As a result, the inside housing 81 is put in the open position and the inner passage openings 89 oppose the outer passage openings 109. Accordingly, the inside housing 81 and the outer passage openings 109 are communicated with each other. Moreover, the shutter 68 is put at the open position, and the frame-side passage openings 34 oppose the cartridge-side passage openings 47 (the inner passage openings 89 and the outer passage openings 109). Accordingly, the frame-side passage openings 34 and the cartridge-side passage openings 47 are communicated with each other.

The frame-side seal 62 is placed between the front wall 57 and the shutter 68, and the outer seal 112 is placed between the shutter 68 and the outside housing 82. The inner seal 92 is placed between the outside housing 82 and the inside housing 81.

During formation of an image, the developer in the inside housing 81 is supplied, through the inner supply opening 90, the outer supply opening 110, and the frame-side supply opening 60, to the inside of the developing part 32 by an agitating action of the agitator 93.

In the meantime, the developer in the developing part 32 is conveyed to from the center position to both sides in the width direction by the auger 35, to thus be supplied to the supply roller 36. In the meantime, the developer is returned to the inside housing 81 through the frame-side return openings 61, the outer return openings 111, and the inner return openings 91. As a result, the developer is circulated between the developing part 32 and the inside housing 81.

(c-2) Detachment of Developer Cartridge from Process Frame

In order to detach the developer cartridge 31 from the process frame 22, the pivotal arm 70 is first swayed from the press position to the press release position. Thereupon, the respective pressing projections 77 depart from the respective press parts 107, thereby releasing the developing part 32 of the developer cartridge 31 from a pressed state.

Moreover, when the pivotal arm 70 is swayed from the press position to the press release position, the respective slide projections 86 fitted into the respective acceptance recess parts 75 make forward sliding movements within the respective slide holes 104 along with swaying action of the respective side plate arms 72, to thus come to the front ends of the respective slide holes 104. Thereupon, the pair of nipping projections 87 provided at both ends of the width direction make upward sliding movements within the respective elongated holes 108 while nipping the shutter 68, to thus be arranged at the upper ends of the respective elongated holes 108.

As a result, the inside housing 81 is put at the close position, and the lower portion of the enclosed area opposes the outer passage openings 109, thereby closing the outer passage openings 109. The shutter 68 is placed at the close position, and the frame-side passage openings 34 oppose the shutter 68, to thus become closed.

When the upper grip plate 114 and the lower grip plate 118 are grasped in the direction they approach each other, the latch claw 117 is disengaged from the upper fixing part 66. Accordingly, so long as the developer cartridge 31 is pulled forwardly from the cartridge housing part 33, the developer cartridge 31 is detached from the process frame 22.

As indicated by a dashed line shown in FIG. 10, in the developing device 17, an arrangement is made such that portions of the shadows of both ends of the width direction of the frame-side seal 62, both ends of the width direction of the inner seal 92, and both ends of the width direction of the outer seal 112 cast in the longitudinal direction overlap the side seal 59.

Therefore, in order to prevent leakage of developer from any position between the front wall 57 and the shutter 68 by the frame-side seal 62, leakage of developer from any position between the shutter 68 and the outside housing 82 by the outer seal 112, and leakage of developer from any position between the outside housing 82 and the inside housing 81 by the inner seal 92, the pressing projections 77 press the press parts 107. As a result, even when the developer cartridge 31 is pressed toward the developing part 32, the process frame 22 can lessen the pressing force by the side seal 59. Consequently, by a simple configuration in which an arrangement is made in such a way that portions of the shadows of both ends of the width direction of the frame-side seal 62, both ends of the width direction of the inner seal 92, and both ends of the width direction of the outer seal 112 cast in the longitudinal direction overlap the side seal 59, deformation in the edges of the cartridge-side passage openings 34 in the process frame 22, the edges of the outer passage openings 109 in the outside housing 82, and the edges of the inner passage openings 89 in the inside housing 81 is reduced, thereby making it possible to prevent leakage of developer.

As shown in FIG. 11, the outer ends of the width direction of the frame-side return openings 61 are placed at inner positions of the width direction (positions closer to the center position of the width direction) as compared with the outer ends of the width direction of the supply roller 36 and the outer ends of the width direction of the sponge roller 42. Therefore, the developer passing through the frame-side passage openings 34 can be supplied to the entire sponge roller 42 in the width direction thereof.

The frame-side passage openings 34 and the cartridge-side passage openings 47 (the inner passage openings 89 and the outer passage openings 109) are provided in number of three while being spaced apart from each other in the width direction. Areas located between the adjacent frame-side passage openings 34 and areas located between adjacent cartridge-side passage openings 47 act as sash bars, so that the edges of the frame-side passage openings 34 in the process frame 22 and the edges of the cartridge-side passage openings 47 in the developer cartridge 31 can be reinforced. As a consequence, deformation in the edges of the frame-side passage openings 34 in the process frame 22 and the edges of the cartridge-side passage openings 47 in the developer cartridge 31 can be diminished to a much greater extent, and leakage of developer can be prevented further.

In the developing device 17, the pressing projections 77 press the press parts 107, thereby pressing the developer cartridge 31 toward the developing part 32. Therefore, leakage of developer from any position between the front wall 57 and the shutter 68, leakage of developer from any position between the shutter 68 and the outside housing 82, and leakage of developer from any position between the outside housing 82 and the inside housing 81 can be prevented reliably by the frame-side seal 62, the outer seal 112, and the inner seal 92, respectively.

Moreover, the respective pressing projections 77 press, in the longitudinal direction, overlaps among the side seal 59, the frame-side seal 62, the inner seal 92, and the outer seal 112. On this account, leakage of developer from any position between the front wall 57 and the shutter 68, leakage of developer from any position between the shutter 68 and the outside housing 82, and leakage of developer from any position between the outside housing 82 and the inside housing 81 are prevented reliably by the frame-side seal 62, the outer seal 112, and the inner seal 92, respectively. In addition, deformation in the edges of the cartridge-side passage openings 34 in the process frame 22, the edges of the outer passage openings 109 in the outside housing 82, and the edges of the inner passage openings 89 in the inside housing 81 can be diminished without fail.

The frame-side passage openings 34 are formed in the front wall 57, and an area of the front wall 57 located around the edges of the frame-side passage openings 34 is provided with the frame-side seal 62. Therefore, it is possible to prevent leakage of developer from any position between the developer cartridge 31 and the process frame 22 by the frame-side seal 62.

The outer passage openings 109 are also formed in the outside housing 82, and an area of the outside housing 82 located around the edges of the outer passage openings 109 is provided with the outer seal 112. Therefore, it is possible to prevent leakage of developer from any position between the developer cartridge 31 and the process frame 22 by the outer seal 112.

The inner passage openings 89 are also formed in the inside housing 81, and an area of the inside housing 81 located around the edges of the inner passage openings 89 is provided with the inner seal 92. Therefore, it is possible to prevent leakage of developer from any position between the inside housing 81 and the outside housing 82 by the inner seal 92.

Leakage of developer in the developing device 17 is prevented reliably, and occurrence of a development failure in the photosensitive drum 25 attributable to leakage of developer can be prevented.

Moreover, the image forming apparatus 1 is equipped with the foregoing developing device 17. Therefore, leakage of developer is prevented with certainty, and occurrence of an image formation failure, which would otherwise be caused by leakage of developer, can be prevented.

Modified Examples

In the above-described aspects, the frame-side seal 62, the outer seal 112, and the inner seal 92 are provided respectively. However, at least any one of them rather than all of them can also be provided.

Further, in the above-described aspects, the developing device 17 is equipped with the photosensitive drum 25, the scorotron-type charger 26, a cleaning brush 27, and the transfer roller 28. However, the body casing 2 may also be equipped with the photosensitive drum 25, the scorotron-type charger 26, the cleaning brush 27, and the transfer roller 28. The body casing 2 can also be attachable to and detachable from the developing device 17.

Still further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

What is claimed is:

1. A developing device comprising:

a housing;

a developing roller that is rotatably provided in the housing and configured to carry developer;

a supply roller provided in the housing, the supply roller configured to supply the developer to the developing roller;

a developer cartridge that is attachable to and detachable from the housing and houses the developer;

a first sealing member that is provided at both ends of a longitudinal direction of the developing roller and slidably contacts a circumferential surface of the developing roller for preventing leakage of the developer from the housing, the first sealing member including an inner end portion;

a developer passage opening for passage of the developer provided in at least one of the housing and the developer cartridge; and a second sealing member provided in a vicinity of the developer passage opening for preventing leakage of the developer from the developer passage opening, at least a part of the second sealing member overlapping the first sealing member in a direction in which the developer cartridge is attachable to and detachable from the housing, wherein the second sealing member is arranged such that:

an outer end portion of the second sealing member in the longitudinal direction is located outside from the inner end portion of the first sealing member in the longitudinal direction, and an inner end portion of the second sealing member in the longitudinal direction is located inside from the inner end portion of the first sealing member in the longitudinal direction, and wherein the developer cartridge is attachable to and detachable from the housing at a position opposed to the developing roller with reference to the supply roller.

2. The developing device according to claim 1, wherein, in a longitudinal direction, an end of the developer passage opening is arranged closer to a longitudinal center than an end of the supply roller.

3. The developing device according to claim 1, wherein the developer passage opening includes a plurality of developer passage openings formed at a spacing in the longitudinal direction.

4. The developing device according to claim 1, wherein the housing includes a pressing member configured to press the developer cartridge toward the developing roller.

5. The developing device according to claim 4, wherein the pressing member is configured to press a portion where the second sealing member overlaps the first sealing member.

6. The developing device according to claim 1, wherein the developer passage opening is provided in the housing, and wherein the second sealing member is provided at a position closer to the housing between the housing and the developer cartridge.

7. The developing device according to claim 1, wherein the developer passage opening is provided in the developer cartridge, and wherein the second sealing member is provided at a position closer to the developer cartridge between the housing and the developer cartridge.

8. The developing device according to claim 1, wherein:

the developer cartridge includes:

an inside housing configured to house the developer; and an outside housing that houses the inside housing and is movable relative to the inside housing;

the developer passage opening is provided in the inside housing and the outside housing; and the second sealing member is provided at a position closer to at least the inside housing between the inside housing and the outside housing.

9. The developing device according to claim 1, further comprising:

a photosensitive member on which an electrostatic latent image is formable.

10. An image forming apparatus comprising:

a developing device comprising:

a housing;

a developing roller that is rotatably provided in the housing and carries developer;

a supply roller provided in the housing, the supply roller configured to supply the developer to the developing roller;

a developer cartridge that is attachable to and detachable from the housing and houses the developer;

a first sealing member that is provided at both ends of a longitudinal direction of the developing roller and slidably contacts a circumferential surface of the developing roller for preventing leakage of the developer from the housing;

a developer passage opening for passage of the developer provided in at least one of the housing and the developer cartridge; and a second sealing member provided in a vicinity of the developer passage opening for preventing leakage of the developer from the developer passage opening, at least a part of the second sealing member overlapping the first sealing member in a direction in which the developer cartridge is attachable to and detachable from the housing; and an image forming apparatus main body, wherein the developing device is attachable to and detachable from the image forming apparatus main body.

11. The developing device according to claim 1, wherein:

the developer cartridge includes:

an inside housing configured to house the developer; and an outside housing that houses the inside housing and is movable relative to the inside housing;

the developer passage opening is provided in the inside housing and the outside housing; and the second sealing member is provided at a position closer to at least the outside housing between the inside housing and the outside housing.

* * * * *